US005755917A

United States Patent [19]

Barnes

[11] Patent Number: 5,755,917

[45] Date of Patent: May 26, 1998

[54] MANUFACTURE OF CONSOLIDATED COMPOSITE WOOD PRODUCTS

[75] Inventor: Derek Barnes, West Vancouver, Canada

[73] Assignee: MacMillan Bloedel Limited, Vancouver, Canada

[21] Appl. No.: 700,019

[22] Filed: Aug. 20, 1996

[51] Int. Cl.[6] ..... B27M 1/02; D21J 1/04

[52] U.S. Cl. ..... 156/296; 156/62.2; 264/108; 264/109

[58] Field of Search ..... 156/62.2, 296; 264/109, 112, 113, 122, 108

[56] References Cited

U.S. PATENT DOCUMENTS

| | | | |
|---|---|---|---|
| Re. 30,636 | 6/1981 | Barnes . | |
| Re. 34,283 | 6/1993 | Barnes . | |
| 3,115,431 | 12/1963 | Stokes et al. . | |
| 3,267,188 | 8/1966 | Bassett et al. | 264/122 |
| 3,874,990 | 4/1975 | Surdyk | 264/122 X |
| 3,880,975 | 4/1975 | Lundmark . | |
| 4,038,131 | 7/1977 | Baldwin et al. . | |
| 4,380,285 | 4/1983 | Burkner et al. . | |
| 4,478,896 | 10/1984 | Barnes et al. . | |
| 4,514,532 | 4/1985 | Hsu et al. . | |
| 4,517,147 | 5/1985 | Taylor et al. . | |
| 4,784,198 | 11/1988 | Pallmann . | |
| 5,017,319 | 5/1991 | Shen . | |
| 5,067,536 | 11/1991 | Liska et al. . | |
| 5,325,954 | 7/1994 | Crittenden et al. . | |
| 5,341,580 | 8/1994 | Teal . | |
| 5,487,460 | 1/1996 | Barnes . | |

FOREIGN PATENT DOCUMENTS

| | | |
|---|---|---|
| 2015038 | 1/1991 | Canada . |

OTHER PUBLICATIONS

Kollmann, F.F.P. and Cote, W.A. Jr., "Principles of Wood Science and Technology–I Wood", 1968, pp. 378–379, 388, 390.

*Primary Examiner*—Steven D. Maki
*Assistant Examiner*—Sam Chuan Yao
*Attorney, Agent, or Firm*—C. A. Rowley

[57] ABSTRACT

Consolidated composite wood products are produced by waferizing wet wood to produce wet green strands and processing the wet green strands by application of adhesive and formation of a lay-up mat for consolidation prior to drying. The lay-up mat is dried in mat form under conditions that maintain the applied adhesive to condition it for the subsequent consolidation step wherein heat and pressure are applied to form a consolidated composite wood product. Preferably, the mat will be formed by orienting the strands to have their longitudinal axes substantially parallel to the longitudinal axis of the product and then the product will be remaned to produce lumber products with the longitudinal axis substantially parallel to the longitudinal axis of the product.

20 Claims, 1 Drawing Sheet

MANUFACTURE OF CONSOLIDATED COMPOSITE WOOD PRODUCTS

FIELD OF INVENTION

The present invention relates to a process of making a consolidated composite wood products, more particularly, the present invention relates to a process permitting minimizing of strand damage for the manufacture of composite wood products.

BACKGROUND OF THE INVENTION

The general process for manufacturing of composite wood products, whether oriented such as oriented strand board (OSB), oriented strand lumber (OSL) or simple wafer board products or the higher strength products such as those sold by Trus Joist MacMillan under the trademarks "TimberStrand" and "Parallam" (see U.S. reissue Pat. Nos. RE34,283 issued Jun. 15, 1993 to Barnes and RE30,636 issued Jun. 2, 1981 to Barnes).

These products are generally manufactured by first forming the strands from conditioned logs which means they are generally still, in what is known as the wet condition, by a suitable waferizer such as those sold by Pallmann company and as described in U.S. Pat. No. 4,784,198 issued Nov. 15, 1988 to Pallmann and Canadian patent application 2,015,038 filed Jan. 14, 1991 to Pallmann, to form strands or wafers of the appropriate length. Generally, for ordinary wafer board or OSB, the strands have a longitudinal length generally less than about 15 cm whereas in higher strength products, strand length is generally longer than 20 cm, preferably longer than 30 cm. Parallam is a different product in that it is not formed from wafers or strands but it is formed by clipping veneer peeled from a log into long strips preferably about 120 cm long which results in a very strong composite wood product.

In the normal processes of producing composite wood products of the OSB, wafer board or TimberStrand variety, the procedure is to dry the wafers immediately after they are produced. The wet wafers are, in some cases, dried in mat form as described for example in U.S. Pat. No. 5,341,580 issued on Aug. 30, 1994 to Teal.

After drying, the strands then blended with adhesive to apply adhesive to the surface of the strands. These strands, with adhesive applied, are then formed into a lay-up mat wherein the strands may be randomly oriented or maybe oriented with their axes substantially aligned with the longitudinal axis of the product being produced by passing same through an orienter such as those described in U.S. Pat. Nos. 4,380,285 issued Apr. 19, 1983 to Burkner, 3,115,431 issued Dec. 24, 1963 to Stokes et al., 5,325,954 issued Jul. 5, 1994 to Crittenden et al. and 5,487,460 issued Jan. 30, 1996 to Barnes. The so formed mat is then consolidated under heat and pressure commensurate with the particular resin being used. Normally, a phenol formaldehyde or an isocyanate resin is used to produce the consolidated composite wood products.

This handling of the wafers or strands, particularly after drying, causes damage to the strand or wafers, sometimes to a substantial degree. Since the strength of the resultant consolidated product, i.e. the Modulus of Elasticity (MOE) may be significantly reduced depending on the degree of damage or shortening of the strands. The damage to the strands may detract substantially from the value and strength of the consolidated product produced. This problem is more pronounced as the length of the strands is increased. The degree of damage and reduction in average length of the strands may result in significantly more wood material having to be screened from the process to obtain the desired quality in the end product.

Generally, the screening, blending and mat forming are operations applied after the strands have been conditioned, i.e. dried, and thus, energy is consumed in drying these wafers or strands that will not be used both in the final product add to the losses the process.

BRIEF DESCRIPTION OF THE PRESENT INVENTION

It is an object of the present invention to provide a new process for producing consolidated composite wood products while reducing strand damage.

Broadly, the present invention relates to a method of producing a consolidated composite wood product comprising waferizing wet solid wood to form wet green strands, applying bonding adhesive to said wet green strands to form wet green strands with applied adhesive, forming said wet green strands with applied adhesive into a lay-up mat of said wet green strands with applied adhesive, drying said lay-up mat to reduce moisture in said wet green strands with applied adhesive to provide a conditioned mat of conditioned strands with a selected moisture content suitable for further processing, further processing said conditioned mat to consolidate said conditioned mat by application of pressure and temperature sufficient to set said adhesive and consolidate said condition mat to form said consolidated composite wood product.

Preferably, said wet solid wood is formed into said wet green strands to provide said wet green strands at a temperature of between 20° and 60° C.

Preferably, said adhesive will be selected from the group consisting of phenol formaldehyde and isocyanate resins.

Preferably, forming comprises orienting said wet green strands with their longitudinal axis substantially parallel to a longitudinal axis of said consolidated composite wood product.

Preferably, said drying comprise passing heated drying air through said lay-up mat.

Preferably, said further processing includes cutting said consolidated composite product substantially parallel to said longitudinal axis of said consolidated composite wood product to provide a consolidated composite wood lumber product.

Preferably, said adhesive application comprises spraying adhesive onto exposed surfaces of said wet green strands.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
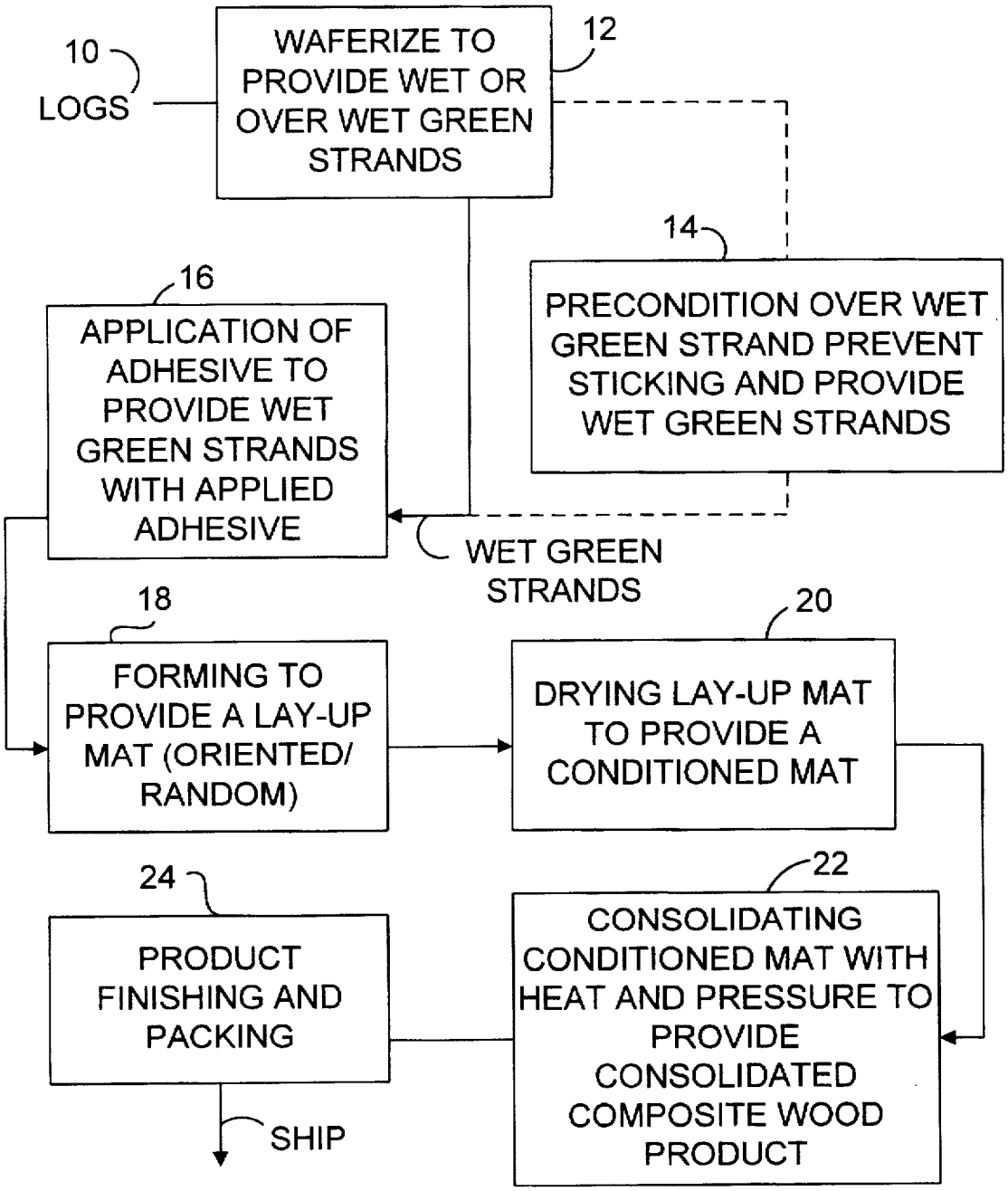
FIG. 1 is a schematic flow diagram of the process of the present invention.

Logs such as those indicated at 10 which have been preconditioned in the normal manner which generally involves passing them through a conditioning pond are waferized as indicated at 12 to provide wet or over wet green strand formed directly from the conditioned logs 10. Preferably, the waferizer used to produced these strands will be a Pallmann waferizer as described above although other waferizers may be used.

The term "wet green strand" means strands that are cut essentially from green wood and contain water in an amount greater than the water saturation point for this species. Such strands are not frozen and generally will be at a temperature of 20°–60° C. The actual amount of moisture contained within the wood strands will vary from species to species.

In those species normally used to produce wafer board OSB or OSL or the like which preferably as an aspenite, the strands so produced, even with unbound surface water will normally be reasonably free flowing, i.e. do not stick together. However, in some suitable species, there may be a tendency for the individual strands to adhere to each other when they are still in wet green form and thus, may be that the over wet green strands must be preconditioned as indicated at 14 to prevent them from sticking together to inhibit uniform application of adhesive to their surfaces and the manufacture of a reasonably uniform density mat. The conditioning carried out in 14 preferably will be an air drying stage where an air is passed through the wet green strands produced at 12 to reduce the moisture content to one that is acceptable and does not cause sticking, while still retaining some moisture, i.e. the preconditioning step 14 is primarily to remove the surface moisture causing the strands to adhere together.

A suitable adhesive is applied to the wet green strands in adhesive application stage indicated at 16. Any suitable adhesive applicator system as used in the industry may be used to apply adhesive to the wet green strands to provide a source of wet green strands with applied adhesive. To minimize strand damage, it is preferred to use a cascade type adhesive applicator such as that described in U.S. Pat. No. 4,478,896 issued Oct. 23, 1984 to Barnes et al..

The adhesive used may be any suitable adhesive, normally used to produce consolidated composite wood products. Normally, the phenol formaldehyde resins or isocyanate resins, the latter being particularly suited where steam pressing is used in the consolidating step as will be described below.

The wet green strands with adhesive applied are then passed through a forming stage 18 to provide a laid-up mat. Any suitable mat forming process may be used to form a conventional unconsolidated lay-up mat (except that the lay-up mat consists of wet green strands as opposed to the conventional dry strands). It is preferred to orient strands to provide an oriented strand lay-up mat with the strands oriented with their longitudinal axes substantially parallel to the longitudinal axis of the consolidated product to be produced. Generally, the degree of orientation will be determined by the particular orienter used and the width of the passages through which the strands must pass while forming the mat. Obviously, other criteria apply as well to determine the degree of orientation of the strands in the mat such as height of the orienter above the mat, type of orienter used, length of strand processed, etc. Thus, the terms "substantially parallel to the longitudinal axis of the product" is intended to include strands oriented in one of the conventional orienters as used in the art (see U.S. Pat. Nos. 4,380,285 issued Apr. 19, 1983 to Burkner, and 3,115,431 issued Dec. 24, 1963 to Stokes et al.) or the preferred systems as described in U.S. Pat. No. 5,325,954 issued Jul. 5, 1994 to Crittenden et al. and most preferably in U.S. Pat. No. 5,487,460 issued Jan. 30, 1996 to Barnes.

The so formed lay-up consists of wet green strands piled one on top of the other in a relatively loose mat form in the lay-up mat and retains this condition through the drying stage as indicated at 20 and into the consolidating stages indicated at 22.

In the drying stage, it is preferred to pass dry heated air through the mat to reduce the moisture content down to a suitable moisture content for processing in the consolidating step. Care must be taken not to subject the mat to conditions that would prematurely set the adhesive or resin applied to the strands. Thus, the drying should be performed at a temperature below the curing temperature of the adhesive which generally will be below about 100° C. The actual conditions of the mat leaving the drying stage 20 may be such that curing is imminent provided the time for passage from the dryer 20 into the consolidation step 22 and the application of heat and pressure in the consolidating step occurs before the resin has cured sufficiently to interfere with the final bonding of the consolidated composite wood product.

One form of dryer suitable for handling the mat through the drying stage, i.e. so that the mat is between the mat confine and its formation not significantly distributed is shown in U.S. Pat. No. 5,341,580 issued Aug. 30, 1994 to Teal.

In some cases where the moisture content of the wet green strands is suitable for further processing steps, particularly for the consolidating steps, the amount of drying performed in stage 20 may be very small or none at all.

A conditioned mat containing conditioned strands (i.e. of the required moisture content for the consolidation stage) leaves the dryer 20 and passes into the consolidating stage 22 which will normally take the form either a steam press or hot press such as multi-opening platen press or the like. Thus, it may be necessary to cut the mat into discrete lengths for feeding into the press. This may be done at an appropriate location in the process after the lay-up mat is formed, i.e. after the lay-up is formed and either before or after the drying step 20.

A platen press such as multi-opening press is used, it is sometimes necessary to apply the mat to a caull sheet for introduction into the press. Again, this may be done in any suitable manner. Where continuous press is used, positioning the mat on a caull plate is not required.

Consolidation step produces a consolidated composite wood product having the desired strength and density for its ultimate use. Consolidated product so produced is then subject to any finishing operation as indicated at 24 and if required, to a suitable packaging operation so that it may then be shipped is indicated at 26.

If a lumber product is to be produced, the finishing step 24 will include a operation for dividing a panel product that would normally be produced in stage 22 into strips by cuts extending substantially parallel to the longitudinal axis of the panel and thus, to the strands as in such cases, the strands will have been oriented substantially parallel to the longitudinal axis of the panel.

It will be apparent that the amount of strand damage that may occur is extremely limited because of the manner in which these strands are handled through the process and further because the strands are wet green strands when they are subject to most of the severe handling stages. It is well known that wet green strands are significantly less brittle than dried strands (see "Principles of Wood Science and Technology—I Wood" by F. F. P. Kollmann and W. A. Cote Jr., 1968). Thus, during the more severe treatment of the strands, i.e. up to the drying stage, the strands are in the best condition to withstand the forces applied thereto and thus, minimize strand damage. After and during drying, the strands are well supported and are subjected to a minimum of forces that would cause strand damage in that they are supported in their mat form during drying and when the conditioned lay-up mat is introduced into the consolidation step and subjected to the conventional consolidation conditions of temperature and pressure for the resin being used.

Having described the invention, modifications will be evident to those skilled in the art without departing from the scope of the invention as defined in the appended claims.

We claim:

1. A method of producing a consolidated composite wood product comprising waferizing solid wood to form wet green strands, applying bonding adhesive to said wet green strands to form wet green strands with applied adhesive, forming said wet green strands with applied adhesive into a lay-up mat of said wet green strands with applied adhesive, drying said lay-up mat of said wet green strands with applied adhesive to reduce moisture in said wet green strands with applied adhesive to a moisture content suitable for consolidating to provide a conditioned mat of conditioned strands, consolidating said conditioned mat by application of pressure and temperature sufficient to set said adhesive and consolidate said condition mat to form said consolidated composite wood product.

2. A method as defined in claim 1 wherein said solid wood is formed into said wet green strands to provide said wet green strands at a temperature of between 20° and 60° C.

3. A method as defined in claim 2 wherein said adhesive is selected from the group consisting of phenol formaldehyde and isocyanate resins.

4. A method as defined in claim 2 wherein said forming of said wet green strands with applied adhesive comprises orienting said wet green strands with their longitudinal axes substantially parallel to a longitudinal axis of said consolidated composite wood product to form said lay-up mat of wet green strands with applied adhesive.

5. A method as defined in claim 4 wherein further processing includes cutting said consolidated composite wood product substantially parallel to said longitudinal axis of said consolidated composite wood product to provide a consolidated composite wood lumber product.

6. A method as defined in claim 5 wherein said applying bonding adhesive comprises spraying adhesive onto exposed surfaces of said wet green strands.

7. A method as defined in claim 2 wherein said drying of said lay-up mat comprises passing heated drying air through said lay-up mat.

8. A method as defined in claim 2 wherein said applying bonding adhesive comprises spraying adhesive onto exposed surfaces of said wet green strands.

9. A method as defined in claim 1 wherein said adhesive is selected from the group consisting of phenol formaldehyde and isocyanate resins.

10. A method as defined in claim 9 wherein said forming of said wet green strands with applied adhesive comprises orienting said wet green strands with their longitudinal axes substantially parallel to a longitudinal axis of said consolidated composite wood product to form said lay-up mat of wet green strands with applied adhesive.

11. A method as defined in claim 9 wherein said drying of said lay-up mat comprises passing heated drying air through said lay-up mat.

12. A method as defined in claim 10 wherein further processing includes cutting said consolidated composite wood product substantially parallel to said longitudinal axis of said consolidated composite wood product to provide a consolidated composite wood lumber product.

13. A method as defined in claim 9 wherein said applying bonding adhesive comprises spraying adhesive onto exposed surfaces of said wet green strands.

14. A method as defined in claim 1 wherein said forming of said wet green strands with applied adhesive comprises orienting said wet green strands with their longitudinal axes substantially parallel to a longitudinal axis of said consolidated composite wood product to form said lay-up mat of wet green strands with applied adhesive.

15. A method as defined in claim 14 wherein further processing includes cutting said consolidated composite wood product substantially parallel to said longitudinal axis of said consolidated composite wood product to provide a consolidated composite wood lumber product.

16. A method as defined in claim 14 wherein said drying of said lay-up mat comprises passing heated drying air through said lay-up mat.

17. A method as defined in claim 16 wherein further processing includes cutting said consolidated composite wood product substantially parallel to said longitudinal axis of said consolidated composite wood product to provide a consolidated composite wood lumber product.

18. A method as defined in claim 14 wherein said applying bonding adhesive comprises spraying adhesive onto exposed surfaces of said wet green strands.

19. A method as defined in claim 1 wherein said drying of said lay-up mat of wet green strands with applied adhesive comprises passing heated drying air through said lay-up mat.

20. A method as defined in claim 1 wherein said applying bonding adhesive comprises spraying adhesive onto exposed surfaces of said wet green strands.

* * * * *